US006883643B2

(12) United States Patent
Robillard

(10) Patent No.: US 6,883,643 B2
(45) Date of Patent: Apr. 26, 2005

(54) SELF-RAISING PLATFORM ASSEMBLY

(75) Inventor: Jean G. Robillard, Ste Thérèse de Blainville (CA)

(73) Assignee: Hydro Mobile, Quebec (CA)

( * ) Notice: Subject to any disclaimer, the term of this patent is extended or adjusted under 35 U.S.C. 154(b) by 15 days.

(21) Appl. No.: 10/363,812

(22) PCT Filed: Sep. 5, 2001

(86) PCT No.: PCT/CA01/01273

§ 371 (c)(1),
(2), (4) Date: Jun. 26, 2003

(87) PCT Pub. No.: WO02/20919

PCT Pub. Date: Mar. 14, 2002

(65) Prior Publication Data

US 2004/0020717 A1 Feb. 5, 2004

(30) Foreign Application Priority Data

Sep. 11, 2000 (CA) ..... 2317987

(51) Int. Cl.[7] ..... E04G 1/18; E04G 3/10

(52) U.S. Cl. ..... 182/146; 182/141

(58) Field of Search ..... 182/141, 146, 182/145, 142, 150, 148, 130, 131, 132; 187/270, 243, 244

(56) References Cited

U.S. PATENT DOCUMENTS

| | | | | |
|---|---|---|---|---|
| 3,323,616 | A | | 6/1967 | Best |
| 4,293,054 | A | | 10/1981 | Pieri |
| 4,294,332 | A | | 10/1981 | Ready |
| 4,809,814 | A | | 3/1989 | St.-Germain |
| 5,159,993 | A | | 11/1992 | St.-Germain |
| 5,271,482 | A | | 12/1993 | Walz |
| 5,575,591 | A | | 11/1996 | Vanderklaauw |
| 5,579,865 | A | | 12/1996 | Butler et al. |
| 5,746,290 | A | * | 5/1998 | St-Germain et al. ..... 182/146 |

* cited by examiner

*Primary Examiner*—Hugh B. Thompson, II
(74) *Attorney, Agent, or Firm*—Collard & Roe, P.C.

(57) ABSTRACT

A self-raising platform assembly (1) comprising at least one mast (3, 5, 113) along which a platform (13) may be moved up or down including the following: a) a base element (9) with a supporting plate (25) connected to a jack (27) and several stabilizer arms (33, 37) incorporating height adjustment, b) modular mast sections (7) made from rectangular sections with openings (63) cut out to form steps and bars (55) to allow adjacent sections to be bolted together, c) hydraulically operated ram lifting mechanism (73, 83, 84) with hooks (77, 79, 81) to engage steps on the mast to raise and lower the platform, d) a plastic lined sleeve (17, 19) on the platform which slides against the mast, e) a modular platform which can be lengthened or widened by adding additional modules (101, 103).

13 Claims, 14 Drawing Sheets

SELF-RAISING PLATFORM ASSEMBLY

CROSS REFERENCE TO RELATED APPLICATIONS

Applicant claims priority under 35 U.S.C. §119 of Canadian Application No. 2,317,987 filed Sep. 11, 2000. Applicant also claims priority under 35 U.S.C. §365 of PCT/CA01/01273 filed Sep. 5, 2001. The international application under PCT article 21(2) was published in English.

BACKGROUND OF THE INVENTION a) Field of the Invention

The present invention relates to several improvements to the basic structure of a scaffolding hereinafter called "platform assembly", which is designed to be self-standing or to be erected close to a building wall in order to help workmen to construct, repair or otherwise work on this wall.

More specifically, the invention relates to improvements made to a self-raising platform assembly comprising at least one mast along which a platform may be moved up or down by means of a lifting mechanism including a hydraulically operated ram extendable and retractable along the mast. The so-made improvements lie in particular in:

the structure of the base of the mast(s);

the structure of the mast(s);

the structure and operation of the lifting mechanism;

the way the platform is guided along the tower(s); and the structure of the platform itself.

b) Brief Description of the Prior Art

Platform assemblies made of modular elements that can be erected close to a building structure so those workmen can work on the same, are well known and commonly used in the construction area.

As non-restrictive examples of such assemblies, reference can be made to U.S. Pat. No. 3,323,616 (BEST) and U.S. Pat. No. 5,159,993 (ST-GERMAIN A.) which disclose platform assemblies wherein the platform are moved by a cable hoist mechanism.

Reference can also be made to U.S. Pat. No. 4,809,814 (ST-GERMAIN J.) which discloses a platform assembly wherein the platform is moved by a set of hydraulically operated rams and hooks devised and positioned to engage steps made in the masts in order to lift up the platform.

Reference can further be made to U.S. Pat. No. 4,293,054 (PIERI) and U.S. Pat. No. 4,294,332 (READY) which disclose platform assemblies comprising two masts along which a working platform may be moved up and down by means of toothed wheels that are driven by an electric motor through a suitable transmission. The toothed wheels are meshed with corresponding gear racks mounted on bars forming part of the masts.

Reference can finally be made to U.S. Pat. No. 5,579,865 (BUTLER et al) which also discloses a platform assembly of the above mentioned type, having a platform whose length and/or width may be adjusted by addition of modular platform segments.

If all these existing platform assemblies are quite efficient, they still need to be improved in numerous ways, especially in terms of structures and operation of its basic components which, to make the platform assembly interesting in use, must be strong, safe, reliable, easy to assemble and preferably modular.

SUMMARY OF THE INVENTION

Thus, the main object of the invention is to satisfy the above need by providing an improved platform assembly of the type disclosed in the above prior art references, which improved platform assembly is very stronger, reliable, easy to assemble and to adapt to the user's requirements, and, of course, very safe.

The platform assembly according to the invention is of the type comprising:

at least one mast made of modular sections devised to be detachably connected to each other in end-to-end relationship, each of said mast(s) being intended to be positioned onto the ground;

a horizontal platform mounted onto the mast(s) in such a manner as to be easily movable up and down along the same, said platform including a frame formed with at least one sleeve through which one of said mast(s) extends, said platform also including a floor; and a lifting mechanism to move the platform up and down along the tower(s), said lifting mechanism being mounted onto the platform and operable from the same.

In accordance with the invention, the platform assembly of the above type is characterized in that the lifting mechanism includes:

a main hydraulic cylinder having an upper end pivotably connected to the sleeve of the platform and a lower end from which projects a piston having a free end with at least one hook pivotably mounted thereto for engagement with the steps equally spaced apart along the corresponding mast;

at least one hook-shaped bar having an upper end pivotably connected to the platform and a lower end shaped and devised to engage and hook onto the steps of the corresponding mast; and at least two back hydraulic cylinders to apply a lateral pressure onto the main cylinder and to actuate the hook-shaped bar(s) to force them to engage the steps or to retract from the same in alternance;

whereby the platform is lifted up when the piston of the main cylinder is pushed down, thereby improving the efficiency and speed of the whole mechanism.

In addition to the above characteristic, the platform assembly according to the invention may also comprise one or more of the following features (a) to (d):

(a) the platform has a width and length that can be easily modified by connection thereto of additional modular, platform segments.

(b) each of the modular sections of each mast is made of a metal plate folded and welded to form a tube of rectangular cross-section in which large holes are made to give a ladder-shape to the section, said tube being reinforced with transverse bars and having a set of longitudinal guiding bars welded at one end thereof to allow positioning and fixation of said section onto another identical section in end-to-end relationship;

(c) each mast is mounted on a base extending upwardly on top of a large supporting plate connected to an implement jack embedded into said base, said base also having an external frame on which is connected to at least one stabilizer arm, whereby height adjustment and lateral stability of the platform assembly are substantially improved, and (d) each sleeve of the platform is held in position and guided along the corresponding mast by means of L-shaped pads made of ultra high molecular weight plastic material, said pads contacting and sliding along corners of the corresponding mast when the platform moves up or down, whereby a smooth and reliable motion is achieved.

The invention and its advantages will be better understood upon reading the following non-restrictive description of several preferred embodiments thereof, made with reference to the accompanying drawings.

DESCRIPTION OF SEVERAL PREFERRED EMBODIMENTS OF THE INVENTION

Figure 1:
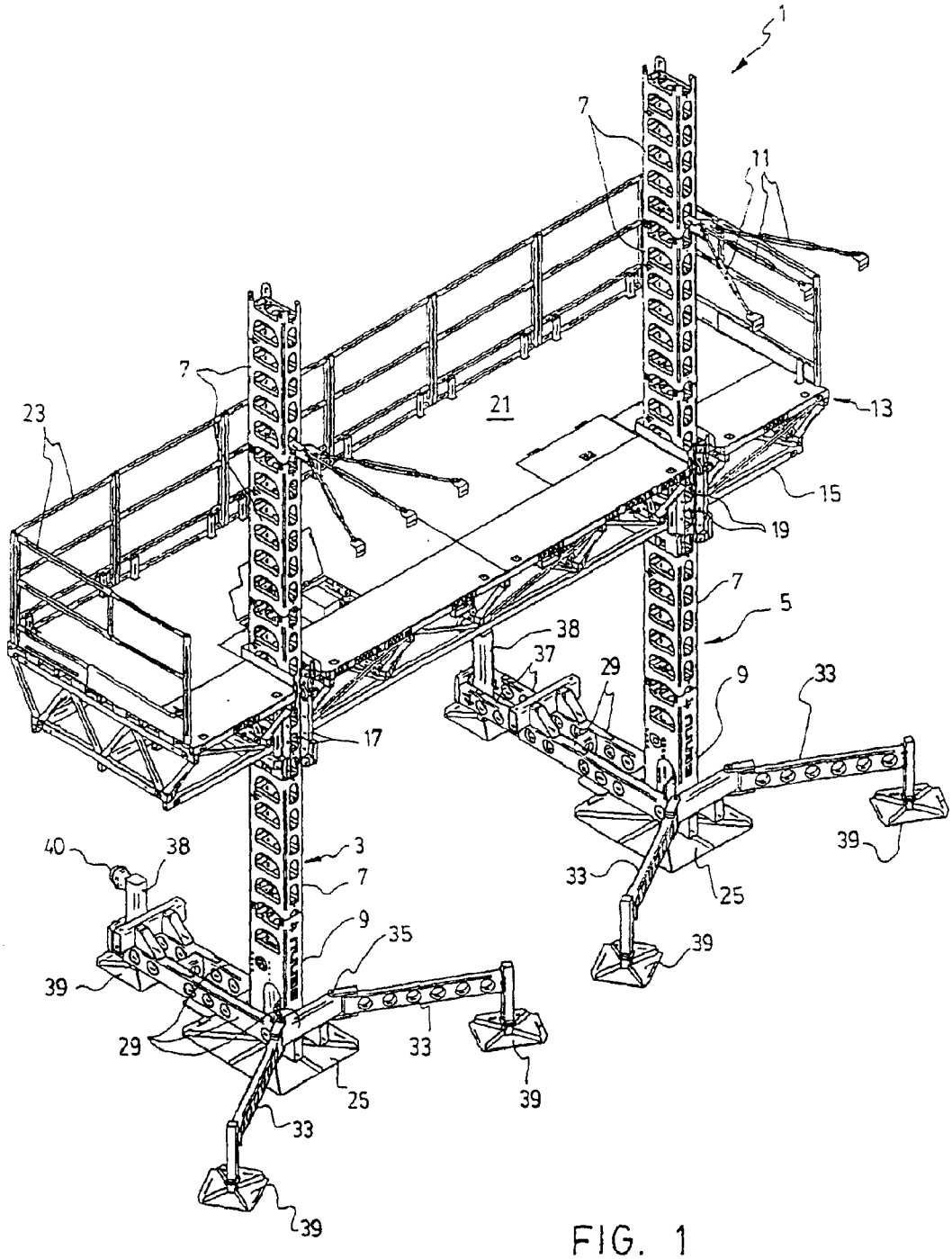
FIG. 1 is a front perspective view of an improved platform assembly according to a first preferred embodiment of the invention.
Figure 2:
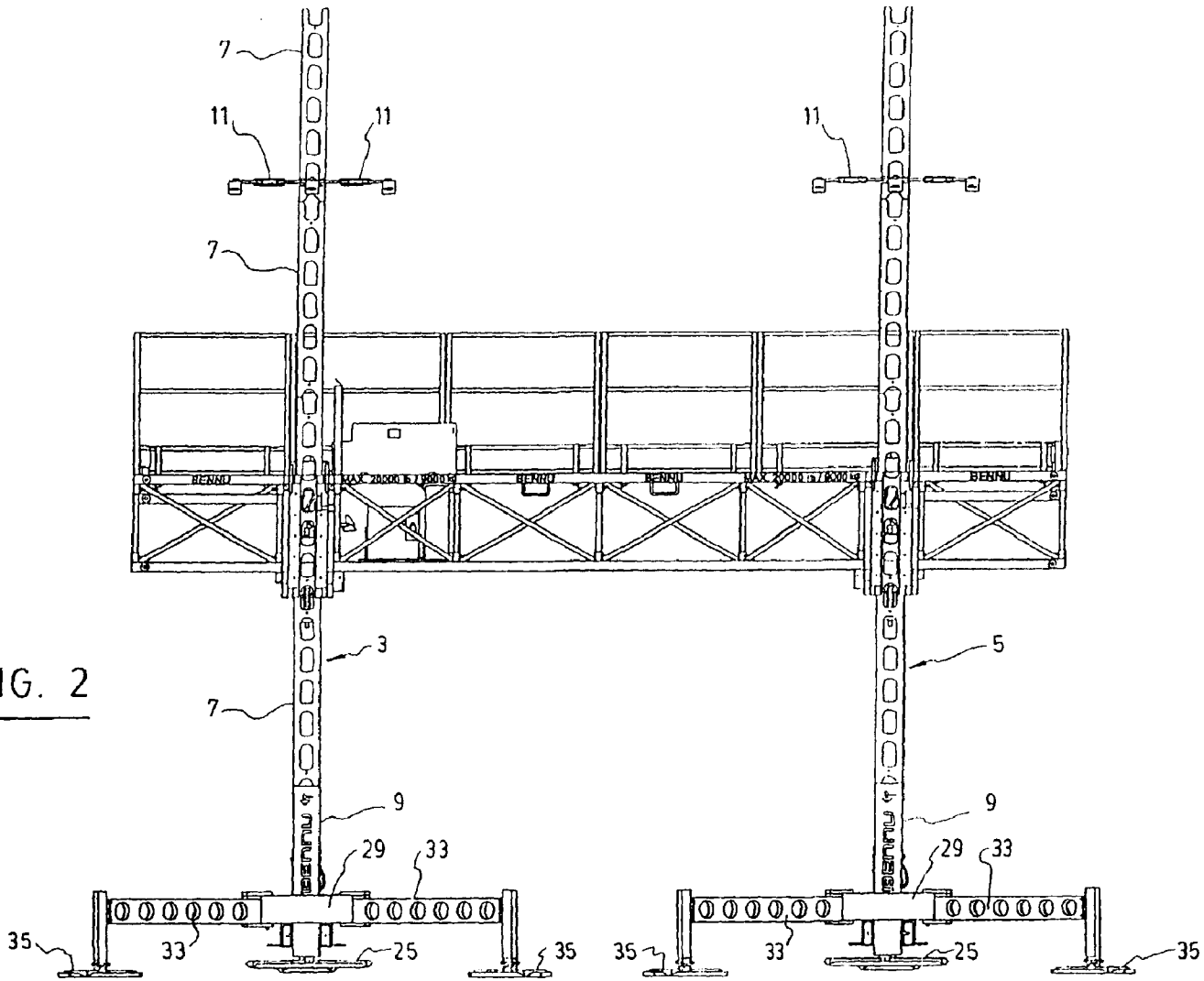
FIG. 2 is a front elevational view of the platform assembly shown in FIG. 1.
Figure 3:
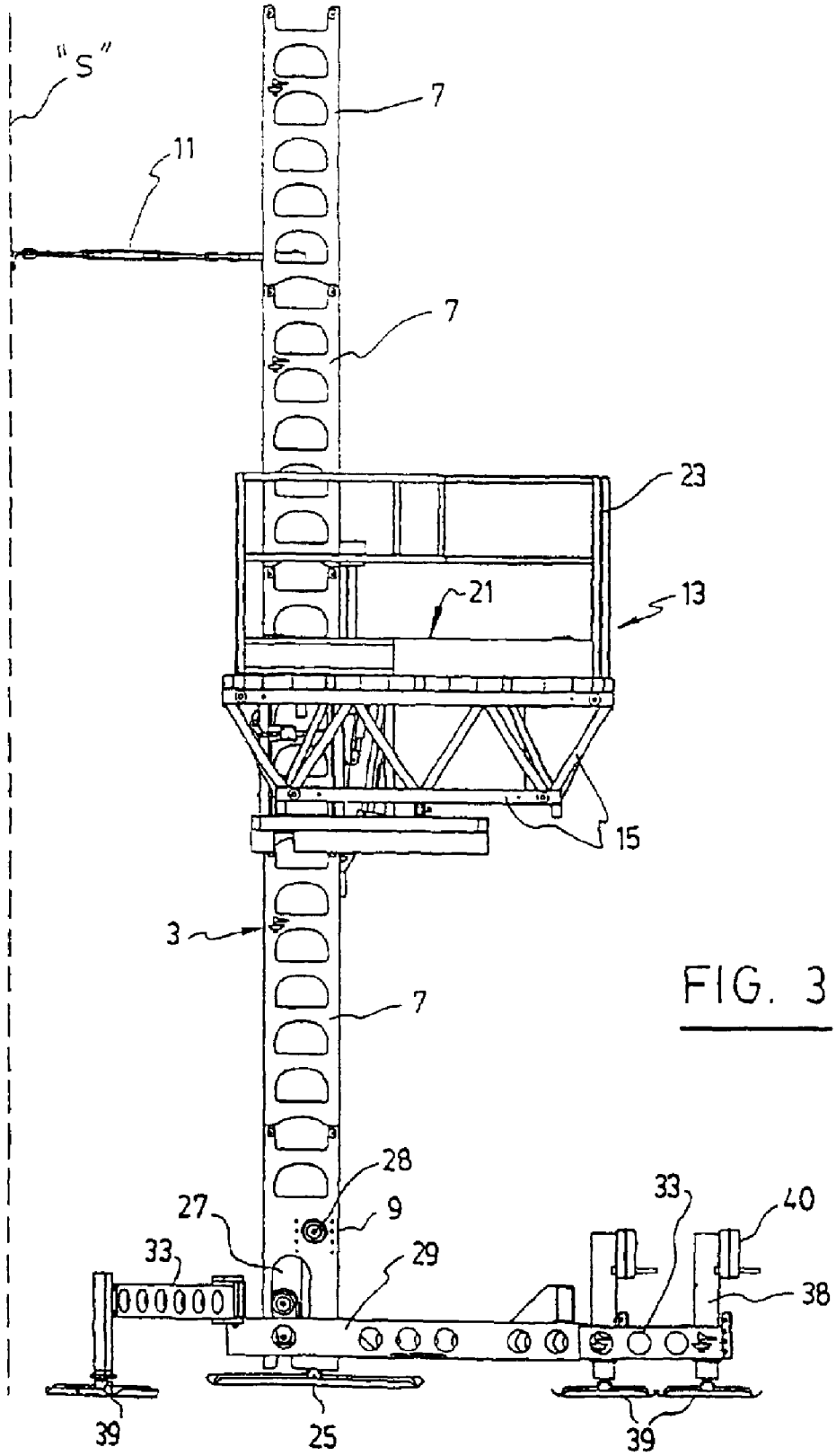
FIG. 3 is a left side elevational view of the platform assembly shown in FIGS. 1 and 2.
Figure 4:
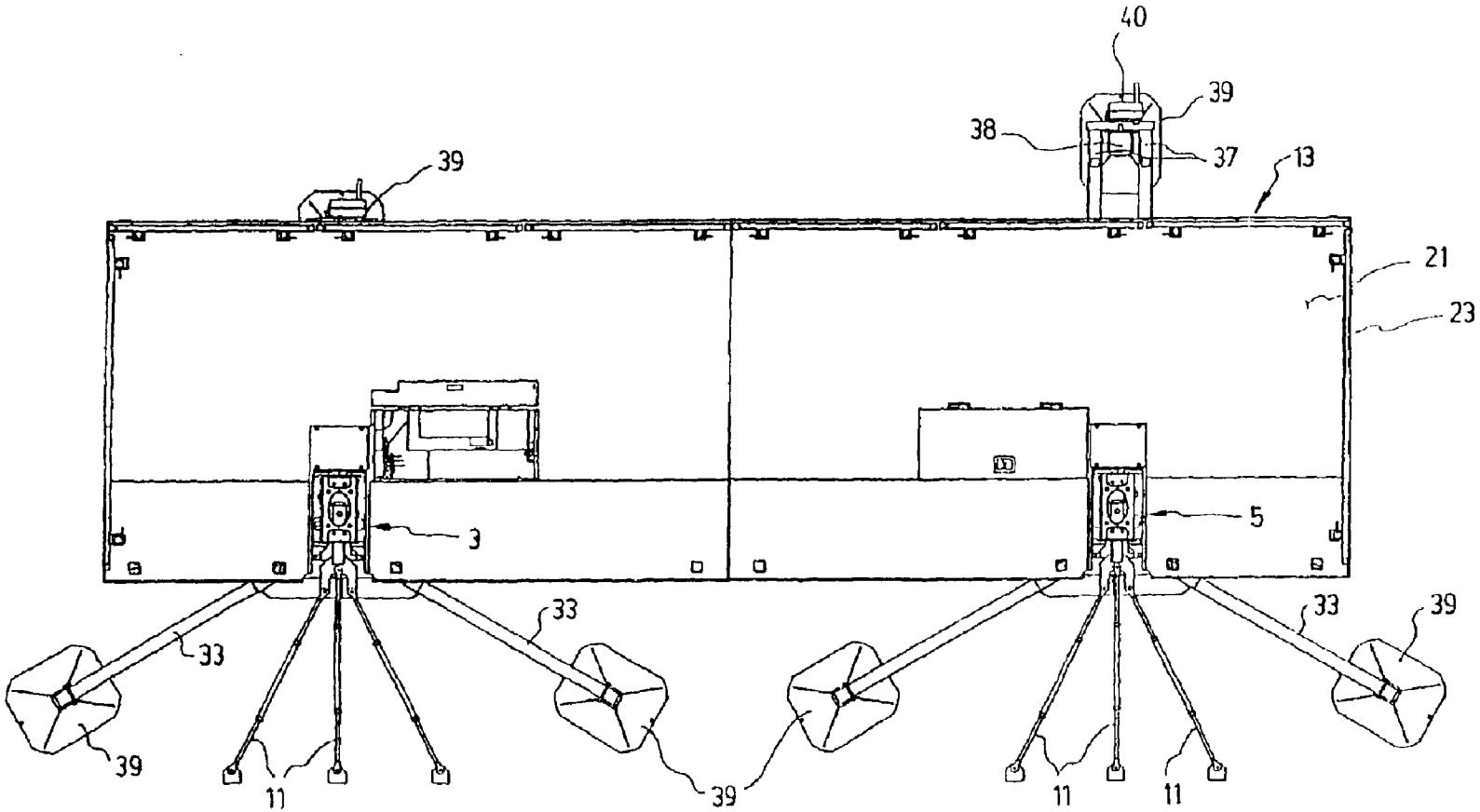
FIG. 4 is a top plan view of the platform assembly shown in FIGS. 1 to 3.

The improved platform assembly 1 according to the first preferred embodiment of the invention as shown in FIGS. 1 to 11, comprises at least one and preferably two or more horizontally spaced apart masts 3,5 each made of modular sections 7 devised to be detachably connected to each other in end-to-end relationship.

Each mast 3,5 has a base 9 that is intended to be positioned onto the ground close to the building structure "S" (see FIG. 3) which is to be erected or repaired. Whenever such is required, tie rods 11 may be installed to connect to the masts to the structure (see again FIG. 3).

An horizontal platform 13 is mounted onto the masts 3,5 in such a manner as to be easily movable up and down along the same. The platform 13 comprises a frame 15 formed with a number of sleeves 17,19 corresponding to the number of the masts 3,5. Each sleeve is devised to receive and slide along a corresponding tower. Preferably, the sleeves have their front faces that are left open so as to allow the platform 13 to be moved up or down along the masts without having to remove the tie rods 11. Of course, a floor 21 and safety guard rails 23 are mounted onto the frame 15.

A lifting mechanism is provided to move the platform 13 up and down along the masts 3,5 whenever such is required. This lifting mechanism is mounted onto the platform and operable from the same, thereby avoiding the necessity of extra equipment like a crane.

The basic structure of the platform assembly 1 disclosed hereinabove, is well known per se and needs not be further described. The utility and advantages of such platform assembly 1 need not be described either, since they are well known. In this connection, reference can be made to the all the patents that have been mentioned hereinabove in the "Background of the Invention".

As already explained above, the present invention essentially lies in several improvements that have been made to the basic structure disclosed hereinabove. Each of these improvements is structurally independent from the others and its relative importance as compared to the others essentially depends on the user's requirement. Accordingly, the improved platform assembly according to the invention may contain only one of these improvements even though, in practice, it should preferably contain several of them, and, even more preferably, all of them. For the very same reason as above, no importance should also be given to the order in which said improvements will now be described.

A first one of these improvements lies in the structure of the base 9 of each mast.

Figure 5:
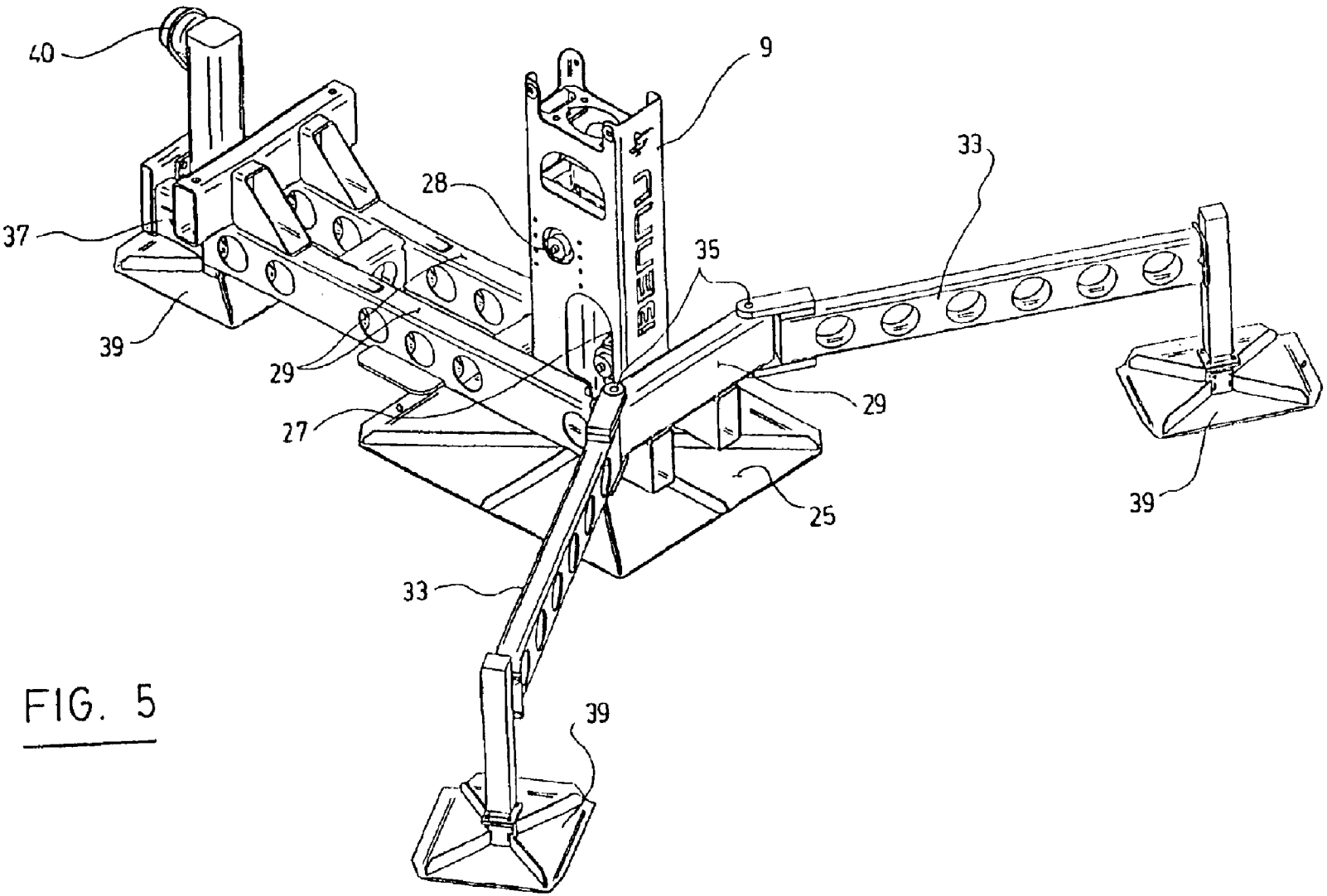
FIG. 5 is a front perspective view of the base of one of the masts of the platform assembly shown in FIGS. 1 to 4.
Figure 6:
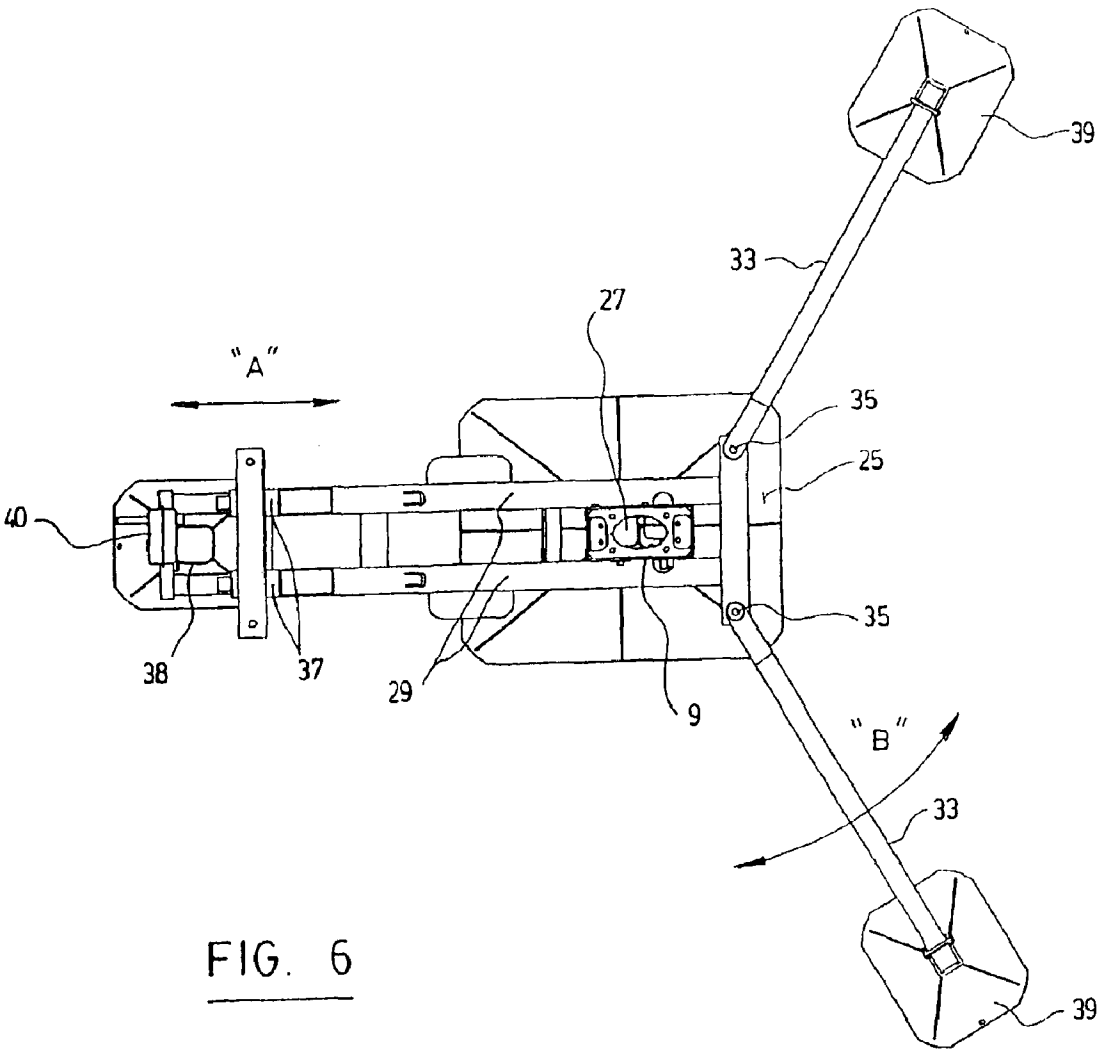
FIG. 6 is a top plan view of the base of the mast shown in FIG. 5.
Figure 7:
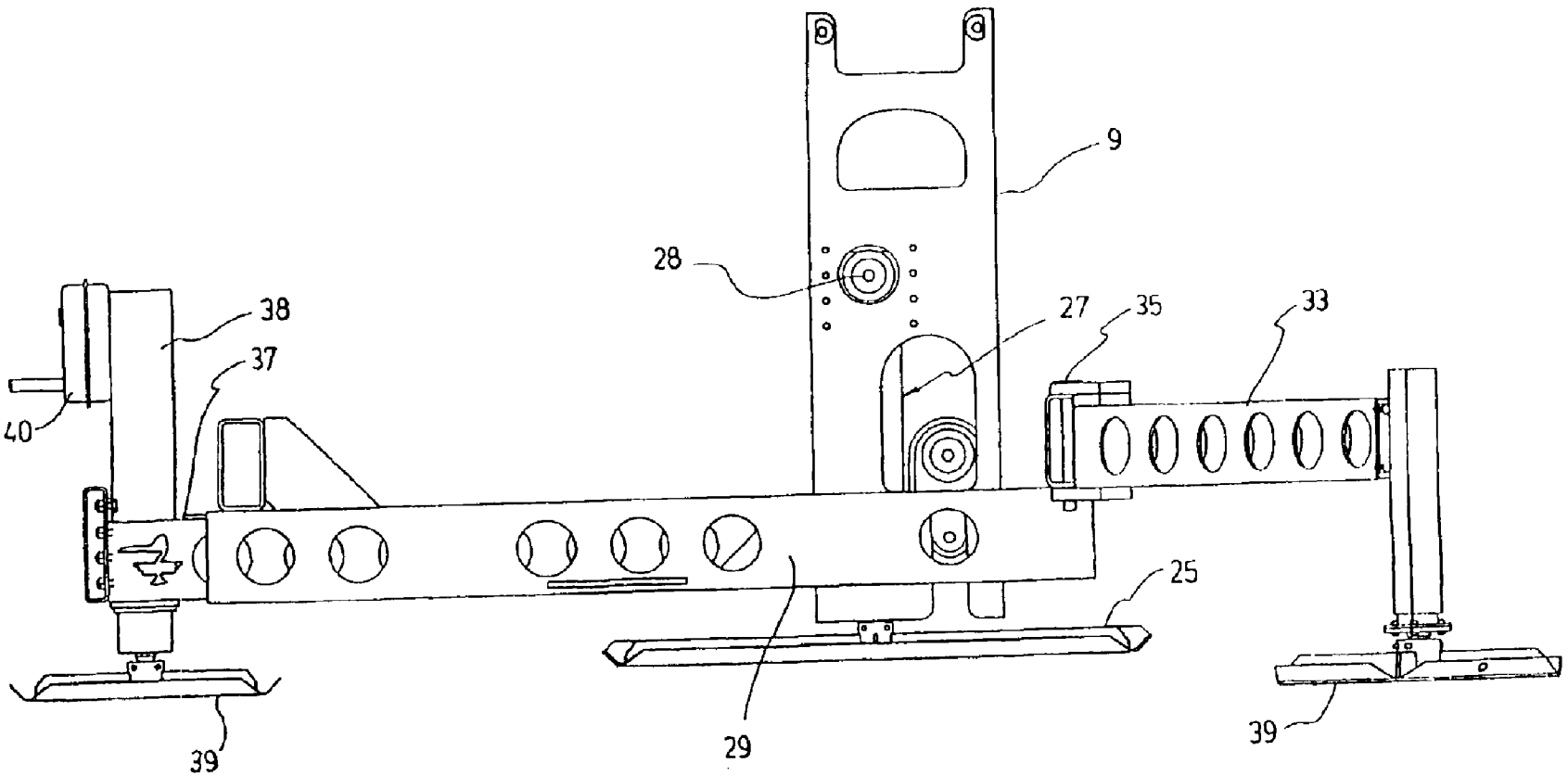
FIG. 7 is a side elevational view of the base of the mast shown in FIGS. 5 and 6.
Figure 8:
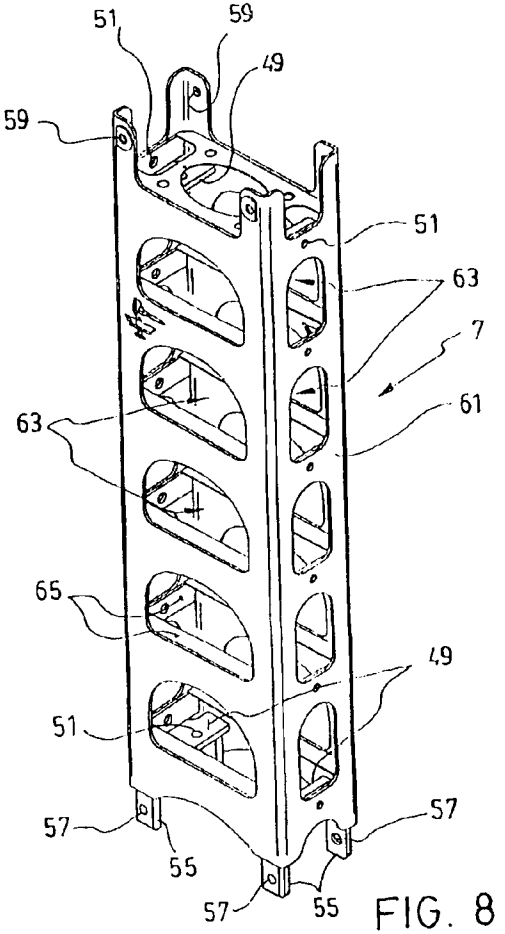
FIG. 8 is a side perspective view of a modular mast section of the masts of the improved platform assembly shown in FIGS. 1 to 4.
Figure 9A:
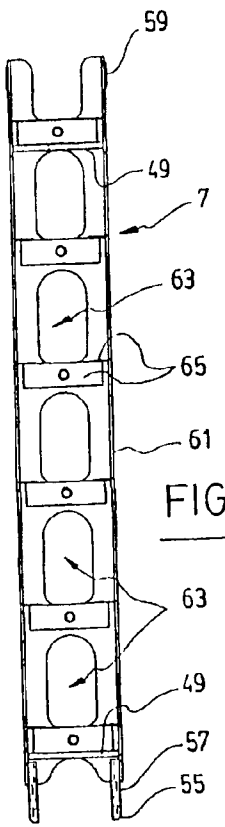
FIGS. 9*a,* 9*b* and 9*c* are a front elevational cross-sectional view, a side elevational cross-sectional view and a top plan view of the modular mast section shown in FIG. 8.
Figure 9B:
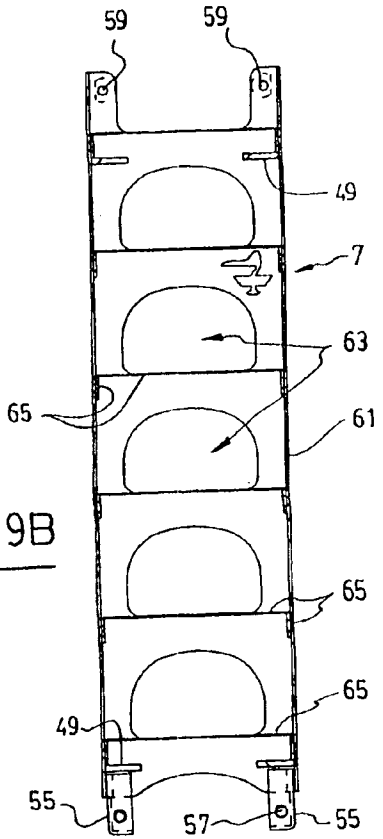
Figure 9C:
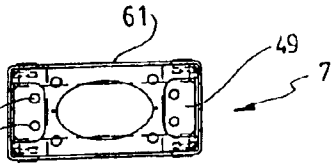

As is better shown in FIGS. 5 to 7, each base 9 extends upwardly on top of a large supporting plate 25 which is itself connected to the bottom end of a vertically adjustable implement jack 27 embedded within the base 9. As it may understood, the jack 27 which is preferably mechanically driven via a gear box 28 can be actuated to adjust the position of the corresponding mast relative to the ground on which the plate 25 is laid down and thus to compensate any defects in the positioning and/or balancing of the platform.

As is also shown in FIGS. 5 to 7, each base 9 is rigidly connected to an external frame 29 made of bars on which at least one and preferably two or more stabilizer arms 33, 37 are mounted.

As is clearly shown, one of these arms, viz. the one numbered 37, is preferably mounted within the frame 29 in such a manner as to be horizontally slidable (see the arrow "A" in FIG. 6). The other arms 33 are preferably mounted on the frame 29 in such a manner as to be pivotable in an horizontal plane (see the arrows "B" in FIG. 6). For this purpose, each stabilizer arm 33 is connected by means of a pin 35 to one end of one of the bars forming the external frame 29. Preferably, each stabilizer arms 33, 37 has a supporting plate 39 in contact with the ground. Preferably also, the plate 39 of the stabilizer arm 37 is mounted onto a retractable jack 38 that can be manually or electrically actuated via a gear box 40.

The way in which the stabilizer arms 33, 37 are mounted and the way in which they can be adjusted, make the base of the mast(s) of the platform assembly 1 easy to install on the premises where the assembly 1 is intended to be used. Moreover, such gives maximum freedom to orient and position the arms on the surrounding ground in such a manner as the mast mounted on the base is properly oriented in vertically position.

As shown, the bases 9 are completely separate from each other. Such is interesting inasmuch as masts 3, 5 may then be positioned at levels different from each other. Such gives a maximum versatility to assembly and portion the whose assembly.

A second improvement made to the basic structure of the platform assembly 1 disclosed hereinabove lies in the structure of the modular sections 7 of the masts 3, 5.

As shown in FIGS. 1 to 4, 8 to 12 and 15 (see more specifically FIG. 8), each mast section 7 is of parallepipedic shape and made of a metal plate 61 that is folded and welded to form a tube of rectangular cross-section. Large holes 63 are made in the sides of the tube formed by the plate 61 to define equally spaced part steps and thus give a "ladder" shape to the tube. Such holes can be cut with a laser beam in a very easy and efficient way. Transverse bars 65 are welded onto the four sides of the tube within the same at the level of each step to reinforce the same.

To facilitate connection of different sections 7 end-to-end, each mast section 7 is provided at one end with a set of guiding bars 55 of rectangular cross-section that are positioned to fit into the corners of the opposite end of the tube of an adjacent mast section. Each bar 55 is provided with a hole 57 that is positioned to be aligned with a corresponding hole 59 made in the tube of the adjacent mast section when these two sections are connected end-to-end. Such permits to lock the sections in line via their corners by means of bolts. Advantageously, the holes 59 made in the plate 61 forming the tube of each section 7 may be reinforced with a hollowed plate to prevent any unwanted wear that could generate a slack when connected with bolts.

Figure 15:
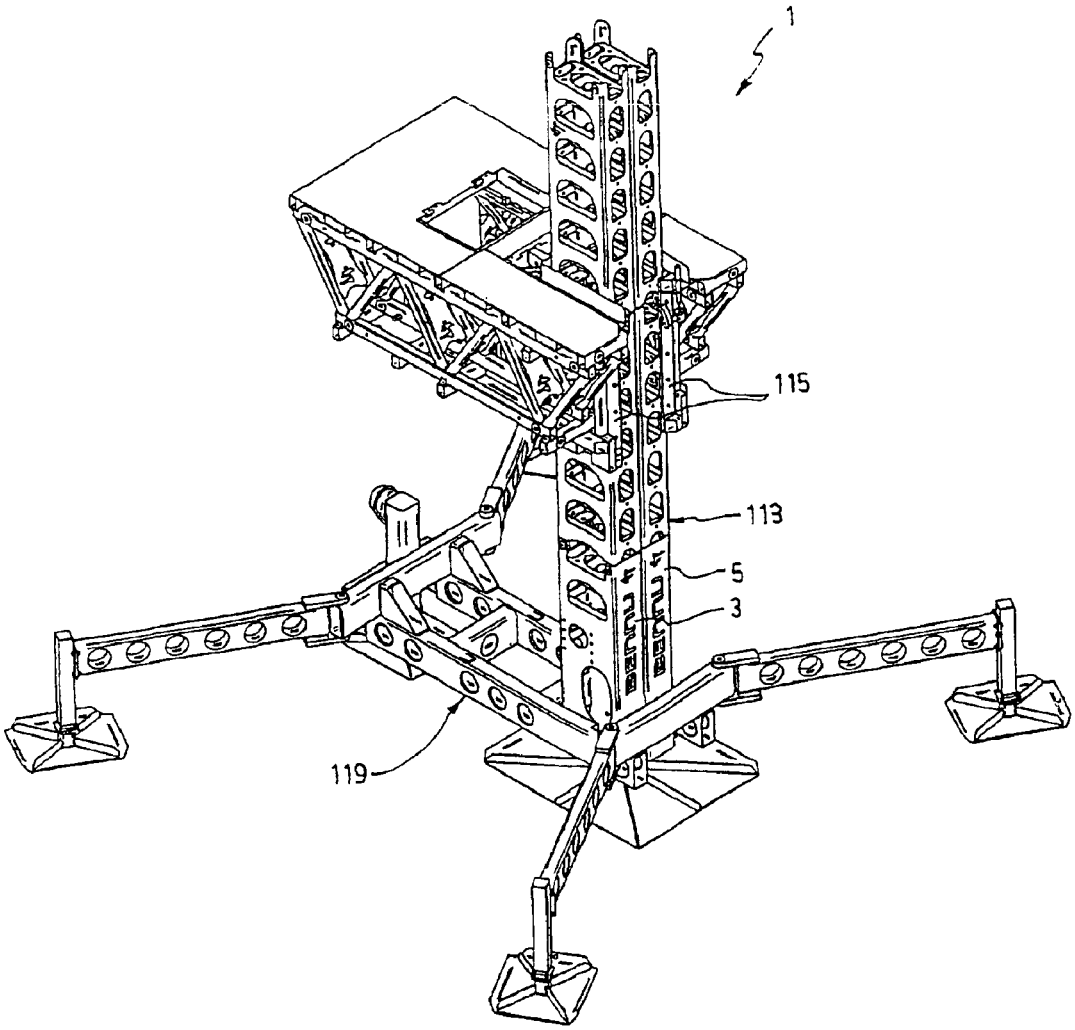
FIG. 15 is a front perceptive view of the base and single mast of an improved platform assembly according to a third preferred embodiment of the invention.

Advantageously, a pair of reinforcing L-shaped transverse bars 49 are fixed to the tube close to the upper and lower ends thereof. These bars 49 are provided with holes 51 in their vertical and horizontal portions. These holes 51 permit to rigidly connect adjacent mast sections 9 by means of upwardly or transversally extending bolts after these adjacent sections have been installed end-to-end and/or in parallel relationship (as shown in FIG. 15). Such permits to make the mast stronger and safer inasmuch as once they are so connected to each other, the risk of shearing of the bolts inserted into the holes 57, 59 is substantially reduced.

The main advantage of the "tube" shaped mast sections 7 shown in FIGS. 8 and 9*a* to 9*c* is that they are very easy and cheap to manufacture. Another advantage is that such section has proved to be stronger than all the existing ladder-shaped mast sections presently in use. It is worth noting however that this improvement, even though it is very interesting, is not an essential one. Indeed, conventional ladder-shaped mast sections could alternatively be used if such was required. It is worth noting also that the use of L-shaped transverse bars 49 and bolts to rigidly connect adjacent mast section to each other could be used with conventional ladder-shaped mast sections.

Of course, the very same manufacturing technology as disclosed hereinabove in connection with the mast sections 7 can be used to prepare the base 9. In this connection, reference can be made to FIGS. 5 and 7 which is illustrative of the shape and configuration that may have the tube of such a base 9 made of a metal plate.

A third improvement made to the basic structure of the platform assembly 1 disclosed hereinabove lies in the structure and operation of the lifting mechanism used to move the platform 13 up and down along the masts 3, 5.

In U.S. Pat. No. 4,809,814 to Jean ST-GERMAN in, there is disclosed a lifting mechanism comprising a pair of anchoring members pivotably carried by the platform adjacent each mast, and alternatively and successively engageable with the steps of the masts so as to suspend the platform at different levels (see claim 1 of this patent). One of these anchoring members consists of a power-actuated member extensible and retractable along the adjacent mast relative to the platform through a stroke equal to the vertical spacing between two adjacent steps. The other anchoring member consists of a hook. Both of these anchoring members are biased against the mast to ensure their automatic engagement with the adjacent steps when the platform is raised or lowered by the extensible members.

In the single exemplified embodiment of the invention disclosed in this U.S. Pat. No. 4,809,814, the power actuated member consists of a double acting hydraulic cylinder that extends upwardly at an angle to as to bear onto the tower by gravity and has lower end pivotably connected to the platform frame and an upper end with a hook shaped to catch the transverse bars forming the steps of the adjacent mast. With such an arrangement, the platform is lifted up and raised when the piston of the main cylinder is retracted.

In accordance with the present invention, lifting of the platform is achieved with a mechanism which is very similar to the one disclosed hereinabove but which works in a completely different way inasmuch as, due to the way the main cylinder is mounted, the platform is lifted up and thus raised only when the piston of the main cylinder is extended. In other words, in operation, the main cylinder does not pull up but rather pushes up the platform.

Figure 10:
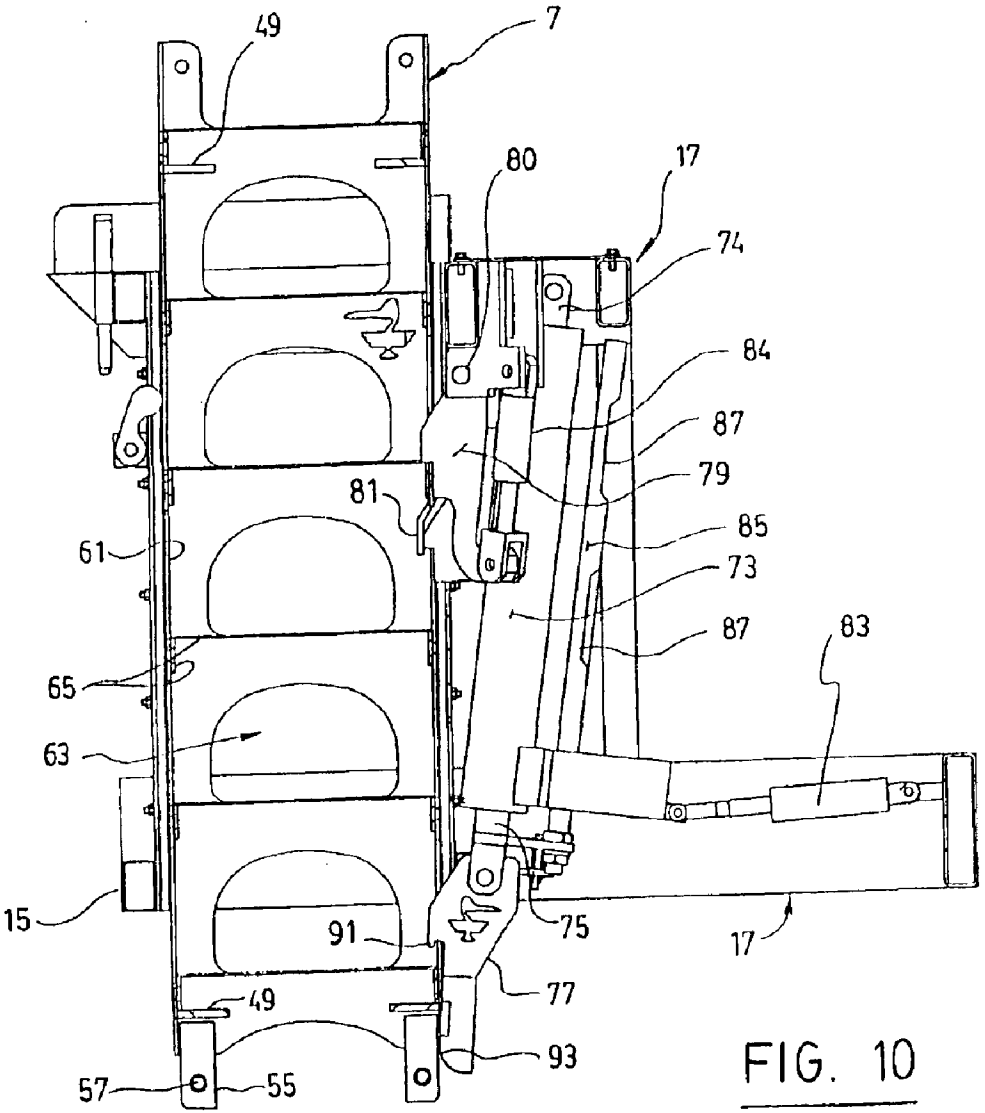
FIG. 10 is a front elevational view in partial cross-section of the portion of the platform adjacent to one of the towers, showing the main cylinder and hooks that are used to lift up and lock the platform along the mast.
Figure 11:
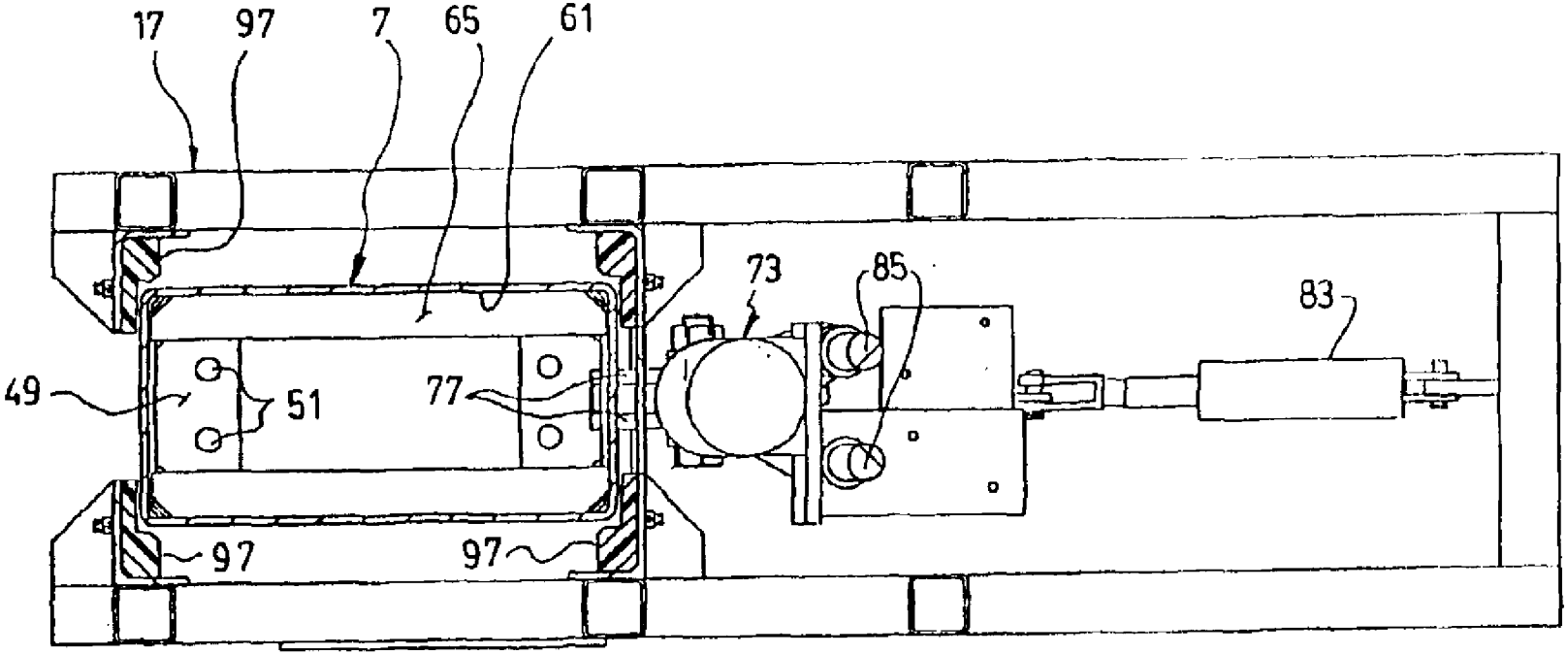
FIG. 11 is a cross-section view taken along lines XI—XI of FIG. 10.

Referring to FIGS. 10 and 11, the lifting mechanism of the improved platform assembly according to the invention comprises, adjacent each mast, a set of anchoring members including:

- a main hydraulic cylinder 73 having an upper end 74 pivotably connected to the structure of the sleeve 17 of the platform and a lower end from which projects a piston 75 having a free end with at least one hook 77 pivotably mounted thereto for engagement with one of the steps made in the sections 7 of the mast; and
- at least one and preferably two hook-shaped bars 79, 81 having their upper ends 80 pivotably connected to the structure of the sleeve 17 and their bottom ends shaped and devised to engage and hook onto another step of the mast.

A first back cylinder 83 is provided to apply a lateral pressure onto the cylinder 73 and thus to force the hook(s) 77 connected to the piston 75 to engage the corresponding step of the mast. Other back cylinder(s) 84 are provided to tilt the hook-shaped bars 79, 81 about their pivot axes at their upper ends to force said bars 79, 81 to engage the other step of the mast.

Advantageously, two guiding rods 85 are fixed to the piston 75 of the main cylinder so as to slide in parallel relationship with respect to the external surface of the main cylinder 73 when the same is actuated. Such guiding rods ensure that the at least one hook 77 be permanently held in operation position by preventing the piston 75 from rotating about its own axis and thus ensure that the hook (s) 77 are always properly positioned with respect to the mast. As is shown, the guiding rod(s) 85 may have recesses 87 made in their surface at given intervals in order to give signals to a control machine upon contact with a proximity switch (not shown) and thus ensure that proper pressure being supplied to the back cylinder 83 depending on the position of the piston 75 of the main cylinder 73.

As aforesaid, the platform 3 Is lifted up when the piston 75 is pushed down. Since the pressure is applied to the whole surface of the piston head that is opposite to the piston rod, the efficiency of the lifting mechanism is improved. In particularly, the lifting speed is increased. During lifting of the platform, the hook(s) 77 and the hook-shaped bars 79, 81 are pushed out while they pass over the transverse bars 85 but they come back to these bars in order to engage the same as soon as they extend on top of it. Of course, the control system must also include means to actuate the back cylinders 83, 84 to force the hook(s) 77 and the hook-shaped bars 79, 81 to retract in order to disengage the steps of the mast when one wants to lower the platform along the tower. Such a retraction must of course be carried out in an alternate and successive manner to ensure that the platform be always held either by the hook(s) 77 or by the hook-shaped bars 79, 81.

It is worth noting that the lifting assembly may comprise one single hook 77 or two of them (as shown in FIG. 11) pivotably attached in parallel relationship to the bottom end of the piston of the main cylinder. It is also worth noting that the way each hook 77 is shaped, is important. Indeed, the hook 77 must have a finger 91 (see FIG. 10) sized and shaped to engage the steps of the mast. It must also have an edge 93 projecting down below the finger 91 so as to bear against the adjacent side wall of mast and the end of the piston 75 and thus prevent the hook 77 from rotating upside down. In other words, the hook 77 must be designed to be self-locking.

A fourth improvement made to the basic structure of the platform assembly 1 disclosed hereinabove lies in the way the sleeves 17 are slidably mounted onto the corresponding masts 3, 5.

So far, it has been suggested to mount guide rollers onto the sleeve for engaging the L-shaped corners of the corresponding mast (see, by way of non-limiting examples, FIGS. 5 and 6 of U.S. Pat. No. 4,809,814 and FIGS. 5 and 8 of U.S. Pat. No. 5,159,993).

It has now been found that better guiding motion and performance are achieved when use is made of L-shaped pads 97 (see FIG. 11) made of a ultra high molecular weight UHMW plastic material, especially UHMW polyethylene, that are positioned to engage the L-shaped corners of the mast section 7. With such pads 97 which are quite resistant to wear, there is no risk that one of the rollers be broken and fall, or be jammed. Moreover, guiding is smooth and perfectly controlled.

A fifth improvement made to the basic structure of the platform assembly 1 disclosed hereinabove lies in the way the horizontal platform 13 is made.

As aforesaid, the platform comprises a frame 15 formed with one or more sleeves 17, 19 devised to receive the corresponding masts 3, 5. The frame 15 supports a floor 21 and safety guard rails 23 that are preferably detachably mounted. For this purpose, the posts of the guard rails 23 are devised to be slid and locked into vertical tubes that are parts of the frame 15 and extend in line with holes made the floor 21. Locking of the posts within the corresponding tubes can be achieved with C-shaped pins or any other suitable means.

The platform 13 may be for example 24 feet (7.3 meters) long and 6 feet (1.8 meters) wide. Its frame 15 can be made of hollow tubes extending longitudinally, transversely and at angles. These tubes are welded to each other. Their lengths and positioning are selected to give to the platform 13 an isosceles trapezium shape when seen in vertical transverse cross-section.

Figure 12:
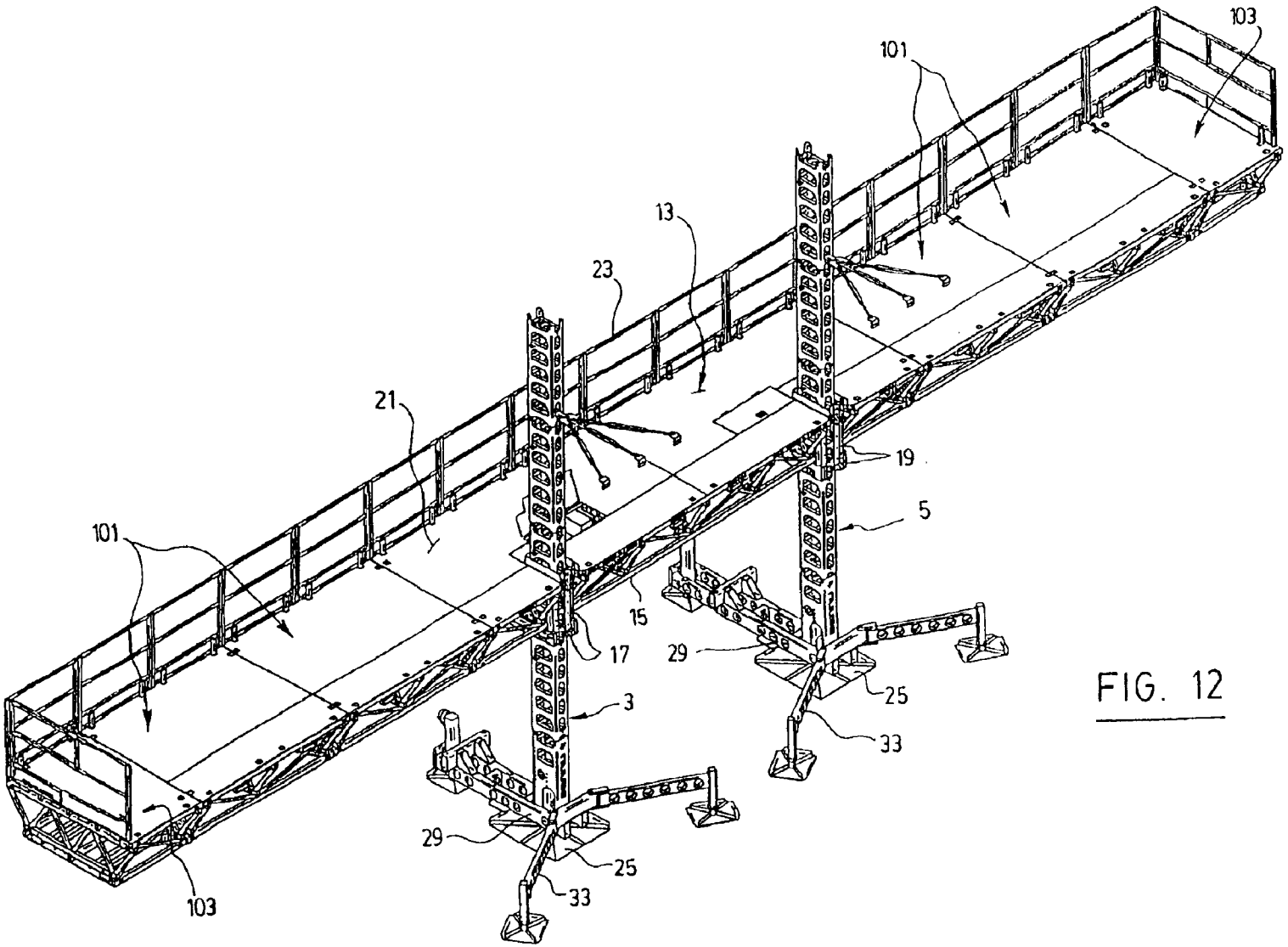
FIG. 12 is a front perspective view of an improved platform assembly according to a second preferred embodiment of the invention which differs form the first one essentially in the length of its platform.

In accordance with a particularly preferred embodiment of the invention shown in FIG. 12, additional modular platform segments 101, 103 (or "wings") are provided to increase the width and/or length of the platform 13 whenever such is required. Extension of the length of the platform may be necessary when the building structure to be erected or repaired is very long. Extension of the width of the platform may also be required when one wants an easy access or contact with the building, structure and the masts 3, 5 are not close enough to allow it (see FIGS. 15*a* and 15*b*).

Figure 13:
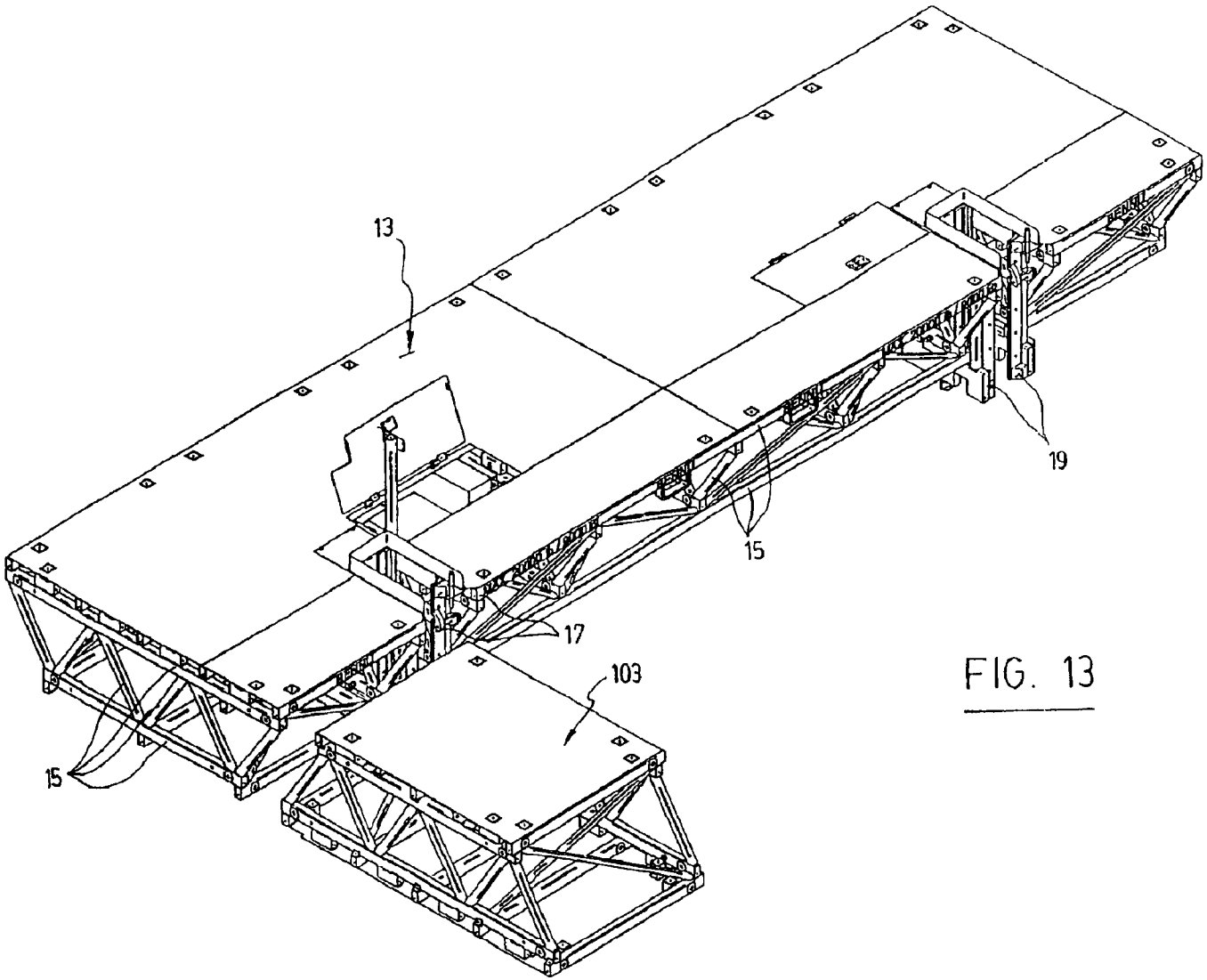
FIG. 13 is a front perspective view of the central segment of the platform of the assemblies illustrated in FIGS. 1 and 12, said FIG. 13 showing how further modular segments can be connected to the central segment of the platform in order to adapt its surface area and design to the workmen's needs.

By way of non-restrictive example, the segments 101, 103 may be 8 feet (2.4 meters) and 4 feet (1.2 meter) long, respectively. As is shown in FIGS. 11 to 14, the segments 101, 103 are of the same transverse isosceles trapezium shape on the platform 13. As a result, they can be connected either in line with the platform 13, as is shown in FIG. 12, or perpendicularly thereto after having been turned upside down, as is shown in FIG. 13. Of course, for this purpose, at least some of the segments like the one numbered 103 in FIG. 13 must be provided with floors on the lower surfaces of their frames.

Figure 14:
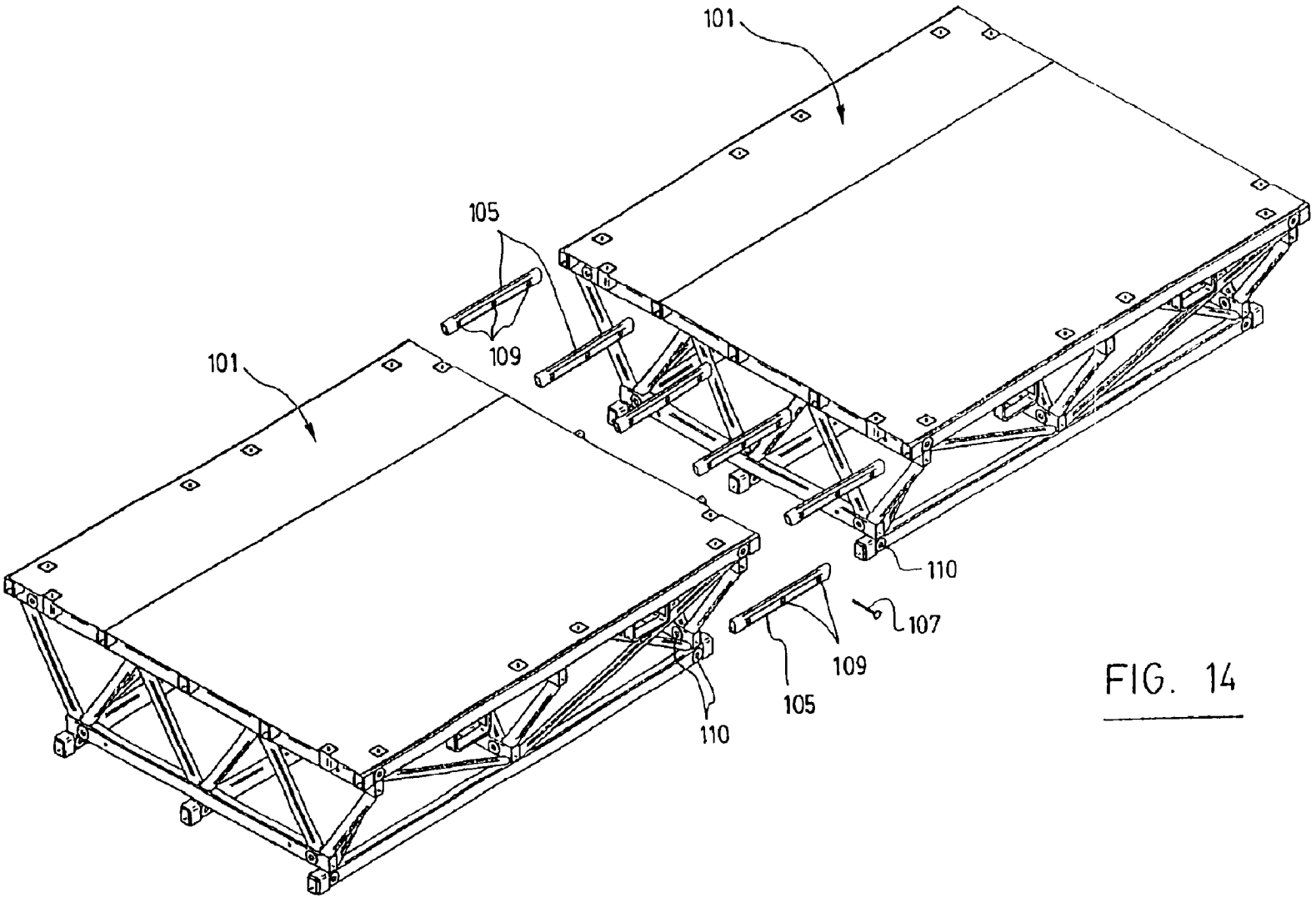
FIG. 14 is an exploded partial perspective view of the connection between two adjacent modular segments of the platform.

The connection between the frames of the main platform 13 and those of the segments 101, 103 can be easily achieved by means of bars 105 (see FIG. 14) that are devised to be inserted into hollow ends of adjacent elements of the frames to be connected, and then be locked in place by means of bolts 107 inserted into holes 109, 110 made in the bars and the element of the frames in which said bars are devised to be inserted (see FIG. 14). Advantageously, the bars 105 have holes 109 at different distances from each other to allow connection of the adjacent elements in end-to-end relationship with their ends either in contact or in slightly spaced part position. Such a "slack" makes it possible to adjust the horizontal orientation of the segments 101, 103 with respect to the frame 15, with each segment at a slightly upwards or downwards angle.

As aforesaid, the improved platform assembly 1 may comprise one or more masts. In the embodiment shown in FIG. 15, the platform assembly comprises one single "double size" mast 113 made of two adjacent masts 3, 5 of the type used in the first embodiment disclosed hereinabove. Of course, the base 119 of the mast 113 and sleeve 115 on the frame of its platform has to be adapted accordingly.

As it may be easily appreciated, numerous structural modifications could be made to the various improvements disclosed hereinabove without departing from the scope of the present invention. By way of examples, the way the structural components are shaped and connected to each other could easily vary form one embodiment to another one. Similarly, the dimensions of the components could easily be varied.

What is claimed is:

1. A platform assembly comprising:

at least one mast made of detachably connected modular sections, said at least one mast being intended to be positioned onto the ground, each of said modular sections being devised to form equally spaced apart steps and be used as a ladder;

a horizontal platform mounted onto said at least one mast in such a manner as to be easily movable up and down along said at least one mast, said platform including a frame formed with at least one sleeve through which said at least one mast extends, said platform also including a floor; and a lifting mechanism to move the platform up and down along said at least one mast, said lifting mechanism being mounted onto the platform and operable from said platform;

wherein said lifting mechanism comprises:

a main hydraulic cylinder having an upper end pivotably connected to the sleeve of the platform and a lower end from which projects a piston having a free end with at least one hook pivotably mounted thereto for engagement with the steps equally spaced apart along said at least one mast, at least one hook-shaped bar having an upper end pivotably connected to the platform and a lower end shaped and devised to engage and hook onto the steps of the corresponding mast; and at least two back cylinders to apply a lateral pressure onto the main cylinder and to actuate said at least one hook-shaped bar so as to force said at least one hook-shaped bar to engage the steps or to retract from said steps in alternance;

whereby the platform is lifted up when the piston of the main cylinder is pushed down, thereby improving the efficiency and speed of the lifting mechanism.

2. The platform assembly of claim 1, further comprising:

additional modular platform segments detachably connectable to the frame of the platform to increase both the length and the width of said platform wherever such is required.

3. The platform assembly of claim 2, wherein each of the modular sections of said at least one mast is made of a metal plate folded and welded to form a tube of rectangular cross-section in which large holes are made to form said steps and give a ladder-shape to the sections, said tube being reinforced with transverse bars.

4. The platform assembly of claim 3, wherein each of the modular sections is connected to an adjacent modular section by means of upwardly extending bolts and has a set of longitudinal guiding bars welded at one end thereof to allow positioning and fixation of said modular sections onto each other in end-to-end relationship.

5. The platform assembly of claim 3, wherein said at least one mast has a base extending upwardly on top of a large supporting plate connected to an implement jack embedded into said base, said base also having an external frame on which is connected at least one stabilizer arm, whereby height adjustment and lateral stability of the platform assembly are substantially improved.

6. The platform assembly of claim 5, wherein said at least one sleeve of the platform is held in position and guided along the corresponding mast by means of L-shaped pads made of ultra high molecular weight plastic material, said pads contacting and sliding along corners of the corresponding mast when the platform moves up or down, whereby a smooth and reliable motion is achieved.

7. The platform assembly of claim 2, wherein said at least one mast has a base extending upwardly on top of a large supporting plate connected to an implement jack embedded into said base, said base also having an external frame on which is connected at least one stabilizer arm, whereby height adjustment and lateral stability of the platform assembly are substantially improved.

8. The platform assembly of claim 2, wherein said at least one sleeve of the platform is held in position and guided along the corresponding mast by means of L-shaped pads made of ultra high molecular weight plastic material, said pads contacting and sliding along corners of the corresponding mast when the platform moves up or down, whereby a smooth and reliable motion is achieved.

9. The platform assembly of claim 1, wherein each of the modular sections of said at least one mast is made of a metal plate folded and welded to form a tube of rectangular cross-section in which large holes are made to form said steps and give a ladder-shape to the sections, said tube being reinforced with transverse bars.

10. The platform assembly of claim 9, wherein each of the modular sections is connected to an adjacent modular section by means of upwardly extending bolts and has a set of longitudinal guiding bars welded at one end thereof to allow positioning and fixation of said modular sections onto each other in end-to-end relationship.

11. The platform assembly of claim 10, wherein said at least one mast has a base extending upwardly on top of a large supporting plate connected to an implement jack embedded into said base, said base also having an external frame on which is connected at least one stabilizer arm, whereby height adjustment and lateral stability of the platform assembly are substantially improved.

12. The platform assembly of claim 1, wherein said at least one mast has a base extending upwardly on top of a large supporting plate connected to an implement jack embedded into said base, said base also having an external frame on which is connected at least one stabilizer arm, whereby height adjustment and lateral stability of the platform assembly are substantially improved.

13. The platform assembly of claim 1, wherein said at least one sleeve of the platform is held in position and guided along the corresponding mast by means of L-shaped pads made of ultra high molecular weight plastic material, said pads contacting and sliding along corners of the corresponding mast when the platform moves up or down, whereby a smooth and reliable motion is achieved.

* * * * *